US005281934A

United States Patent [19]

Shiau et al.

[11] Patent Number: 5,281,934

[45] Date of Patent: Jan. 25, 1994

[54] COMMON INPUT JUNCTION, MULTIOCTAVE PRINTED MICROWAVE MULTIPLEXER

[75] Inventors: Ming-Jong Shiau, Cerritos; John C. Tippet, Rancho Palos Verdes, both of Calif.

[73] Assignee: TRW Inc., Redondo Beach, Calif.

[21] Appl. No.: 865,571

[22] Filed: Apr. 9, 1992

[51] Int. Cl.[5] ..... H01P 1/213

[52] U.S. Cl. ..... 333/134; 333/204

[58] Field of Search ..... 333/126, 128, 129, 132, 333/134, 135, 204

[56] References Cited

U.S. PATENT DOCUMENTS

| | | | |
|---|---|---|---|
| 2,302,852 | 11/1942 | Goddard | 333/132 X |
| 3,875,538 | 4/1975 | Minet et al. | 333/204 |
| 4,210,881 | 7/1980 | Rubin | 333/204 X |

FOREIGN PATENT DOCUMENTS

| | | | |
|---|---|---|---|
| 73539 | 6/1979 | Japan | 333/134 |
| 1330838 | 9/1973 | United Kingdom | 333/132 |

*Primary Examiner*—Paul Gensler

*Attorney, Agent, or Firm*—Ronald L. Taylor

[57] ABSTRACT

A common input junction, multioctave, printed microwave multiplexer. In a first preferred embodiment the multiplexer is in the form of a microstrip. In an alternative preferred embodiment the multiplexer is provided in the form of a suspended substrate multiplexer. Each of the preferred embodiments include independently formed first, second and third channels each having an input and an output, with the input of each channel being coupled together and to a common input junction. The channels are adapted to simultaneously receive radio frequency (RF) signals in the range of, for example, about 3 to 18 GHz. The first independent channel provides an RF output signal having a frequency range of preferably about 3 to 5.5. GHz. The second independent channel provides an RF output signal having a frequency range of about 5.5 to 10 GHz, and the third independent channel provides an RF output signal having a frequency range of about 10 to 18 GHz. The multiplexer is significantly smaller in size and weight than conventional combline and suspended substrate multiplexers, provides significantly fewer component parts, and requires no calibration adjustments.

21 Claims, 2 Drawing Sheets

COMMON INPUT JUNCTION, MULTIOCTAVE PRINTED MICROWAVE MULTIPLEXER

BACKGROUND OF THE INVENTION

Background and Summary of the Invention

1. Technical Field

This invention relates to multiplexers, and more particularly to a multioctave printed multiplexer having a plurality of independent channels coupled at their inputs to a common input junction.

2. Background

Satellites and many avionic systems require broad band arrays to perform functions such as electronic beam steering, target tracking and scan loss recovery. Signals from the array elements must typically be frequency-multiplexed into suboctave bands before weighting and combining in a beam forming network. It is therefore important that the multiplexers be not only wide band, but also small and low cost to make them suitable for mass production applications and applications where having a small physical size is highly desirable.

Current multiplexer technologies include conventional waveguide, combline and suspended substrate implementations. Each of these technologies, however, suffers from one or more drawbacks which limit their utility in satellite and avionic systems. Waveguide multiplexers are typically too bulky and have overall dimensions unsuitable for applications involving satellites and avionic systems. Moreover, waveguide multiplexers are suitable only for narrow band applications having frequency variations of typically less than 10 percent.

Combline multiplexers are relatively expensive to fabricate, assemble and test in large quantities. Such multiplexers are also undesirably bulky and typically have dimensions making them less than desirable for satellite and avionic systems.

Suspended substrate technology generally uses a plurality of highpass and lowpass filters to extract desired bandwidths from each channel sequentially. However, the number of high pass and lowpass filters required to effect the desired degree of multiplexing, typically at least 5 to 6 such filters being required, results in a multiplexer having a larger size than what is ideally desired, in addition to higher inband RF signal loss. The generally high inband RF signal loss degrades the sensitivity of such multiplexers and further limits their utility in many satellite and avionic systems applications.

It is therefore a principal object of the present invention to provide a microwave multiplexer particularly well suited for satellite and avionic systems applications where the multiplexer is extremely compact and light in weight, as well as particularly well suited for low cost mass production.

It is further an object of the present invention to provide a multiplexer having a plurality of independent channels each having an input coupled to the inputs of each of the other channels and to a common input junction, to thereby reduce the number of highpass and lowpass filters required to effect the desired degree of multiplexing.

It is still a further object of the present invention to provide a common input junction, printed multioctave multiplexer which may be formed with either a suspended substrate or a microstrip. It is yet another object of the present invention to provide a common input junction, printed multioctave multiplexer which provides improved adjacent channel rejection at its crossover frequencies and reduced inband RF signal loss at each of its outputs.

SUMMARY OF THE INVENTION

The above and other objects are accomplished by a common input junction, printed multioctave microwave multiplexer in accordance with the preferred embodiments of the present invention. In the first preferred embodiment, the multiplexer is provided in the form of a microstrip multiplexer having a common input junction and a plurality of independent channels. Each of the channels includes an input which is coupled to each other and to the common input junction. Each of the independent channels is operable to receive an RF signal at the common input junction and to provide an RF signal in accordance with a predetermined frequency bandwidth at an output thereof.

In an alternative preferred embodiment of the present invention a common input junction, printed multioctave multiplexer is disclosed in the form of a suspended substrate multiplexer. The suspended substrate multiplexer generally includes first and second housing members and a substrate disposed therebetween. The substrate includes a common input junction which is tied to an input of plurality of independent channels formed on the substrate. Each of the channels is operable to receive a radio frequency input signal at the common input junction and to provide a radio frequency signal at an output thereof in accordance with a predetermined frequency bandwidth.

Each of the preferred embodiments provides a common input junction multiplexer which is significantly more compact, light in weight, and includes significantly fewer parts than heretofore developed conventional combline and conventional suspended substrate multiplexer designs. The preferred embodiments are particularly well adapted to satellite and avionic systems applications where compact, lightweight components are particularly desirable. The preferred embodiments further lend themselves well to low cost mass production and require a significantly lesser degree of calibration prior to use.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
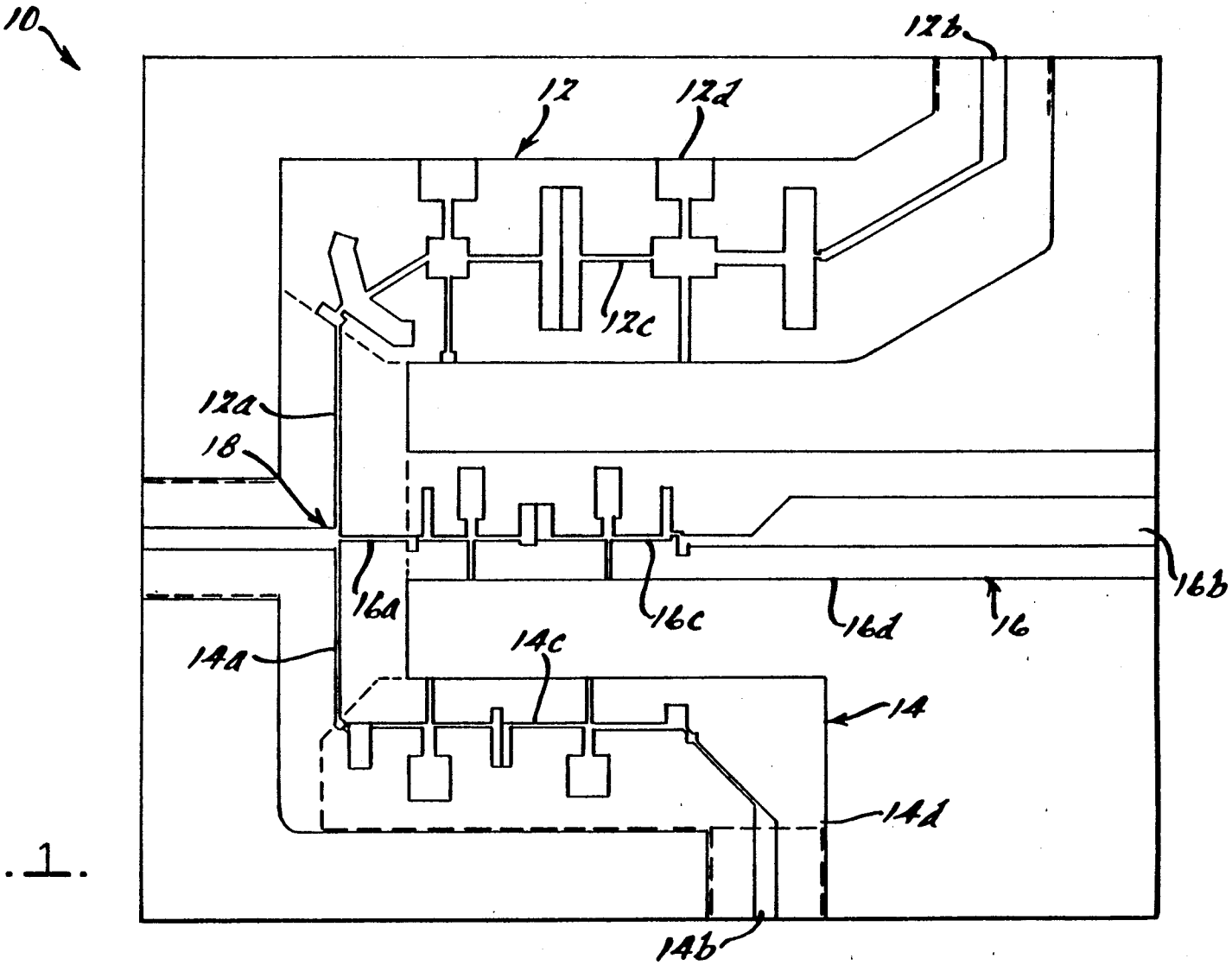
FIG. 1 is a plan view of a common-input junction, microstrip multiplexer in accordance with a first preferred embodiment of the present invention.

Referring to FIG. 1, a common input junction, printed multioctave, microwave multiplexer 10 in accordance with a first preferred embodiment of the present invention is disclosed. The multiplexer 10 generally includes a first independent multiplexer channel 12, a second independent multiplexer channel 14, and a third independent multiplexer channel 16. Each one of the channels 12, 14, 16, includes a circuit element 12c, 14c, 16c having an input 12a, 14a and 16a respectively, which are each coupled together to a common input junction or input port 18. Each of the circuit elements 12c, 14c, 16c of the channels 12, 14, 16 further include an output 12b, 14b and 16b. The first channel 12 receives an RF input signal preferably between about 3 to 18 GHz and provides an RF output signal at its output 12b in the range of preferably about 3 to 5.5 GHz. The second channel 14 simultaneously receives the same RF input signal and provides an RF output signal at its output 14b in the range of preferably about 5.5 to 10.0 GHz. The third channel simultaneously receives the same RF input signal and provides an RF output signal at its output 16b which is preferably within the range of about 10.0 to 18 GHz. Accordingly, the frequency outputs 12b, 14b, 16b are contiguous and collectively cover the entire bandwidth of the RF input signal. It will be appreciated, however, that the input frequency of 3 to 18 GHz has been picked for illustrative purposes only, and that other frequency ranges may be generated at outputs 12b, 14b, 16b depending upon the frequency range of the input signal.

The first and second channels 12 and 14, respectively, each include a substrate material 12d and 14d, respectively, which is preferably comprised of an approximately 0.025 inch thick section of aluminum oxide ($Al_2O_3$). The third channel 16 preferably comprises an approximately 0.025 inch thick quartz substrate 16d. The substrates 12d, 14d, 16d for each of the channels 12, 14, 16 may further be mounted on or otherwise secured to a housing member or any other planar surface suitable for supporting the substrates 12d, 14d, 16d.

Overall, the multiplexer 10 forms a very compact device having a length of about 1.2 inch, a width of about 1.2 inch, and a thickness of about 0.5 inch, and weighs approximately 0.91 ounces. In contrast, conventional combline multiplexers typically have a length of about 2.5 inches, a width of about 1.5 inch and a thickness of about 0.75 inch, and weigh generally about 3.2 ounces. Accordingly, the microstrip multiplexer 10 of the present invention represents a significantly more compact and light weight multiplexer.

Each channel 12, 14, 16 is further implemented as a conventional, elliptical function filter which further minimizes size and insertion loss (i.e. transmission noise) of each channel 12, 14, 16 to typically only about 0.85–1.0 dB. The adjacent channel rejection of the microstrip multiplexer 10 is further between about 40 to 70 dB at about 10 percent from the cross over frequency.

The circuit elements 12c, 14c and 16c are further generally less than ⅛ wavelength in length, instead of the conventional ½ wavelength elements used in typical highpass/lowpass filter designs of multiplexers. The short length of the circuit elements 12c, 14c, 16c not only make the multiplexer 10 much smaller but also enhance its out-of-band rejection performance, and make possible a multioctave multiplexer design having a 6:1 bandwidth. In addition, all of the circuit elements 12c, 14c, 16c can be either printed or etched on the substrates 12d, 14d, 16d of each of the channels 12, 14, 16, thus making low cost mass production possible.

From the above, it will be apparent that the microstrip multiplexer 10 of the present invention requires only three filters in comparison to at least 5 or 6 highpass/lowpass filters typically required by prior designs of suspended substrate multiplexers. Furthermore, since all three channels 12, 14 and 16 are connected directly at a single point, i.e., common input junction 18, no external matching circuits are required.

Figure 2:
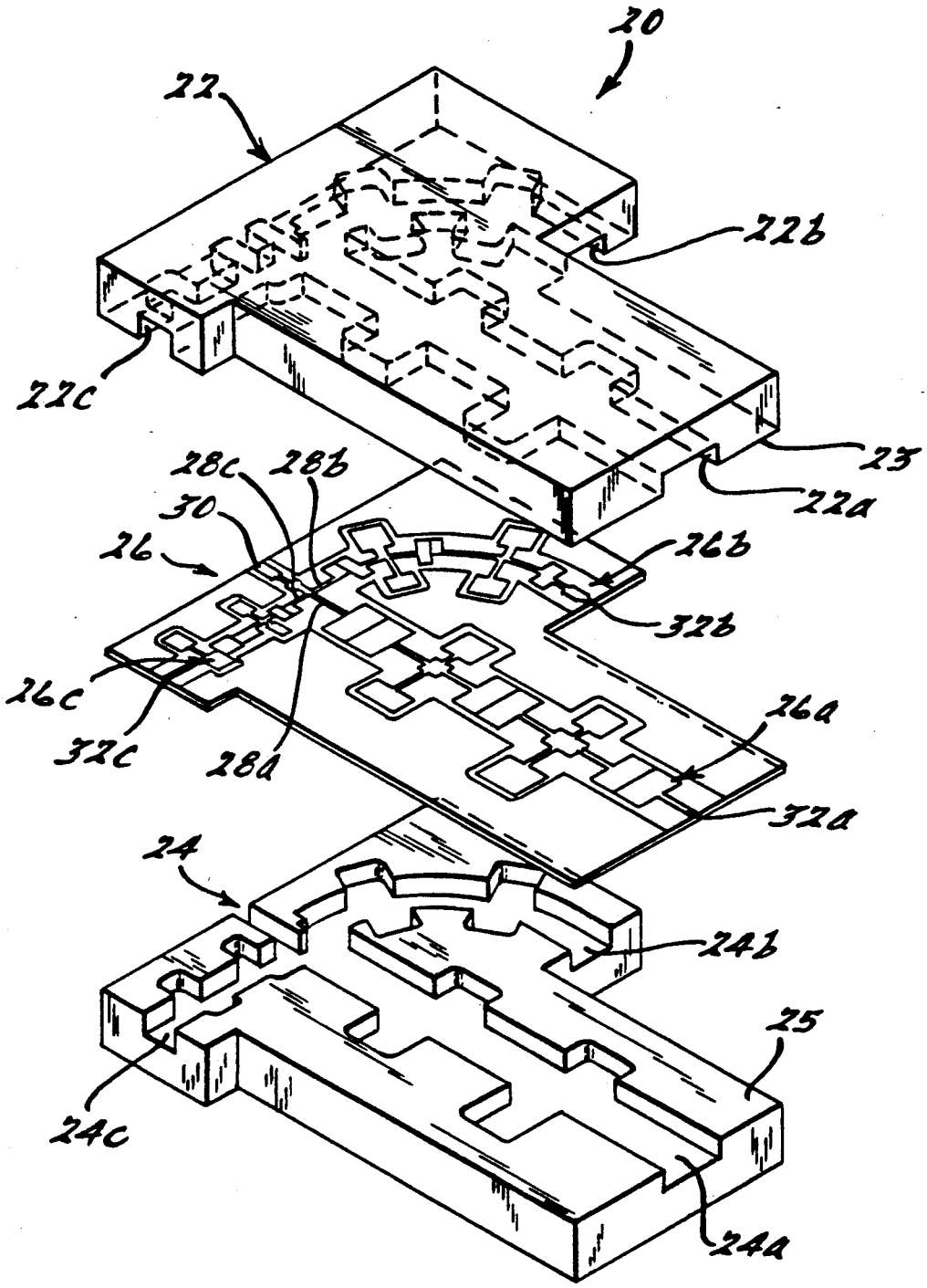
FIG. 2 is an exploded perspective view of a common input junction, suspended substrate multiplexer in accordance with an alternative preferred embodiment of the present invention.

Referring now to FIG. 2, there is shown a common input junction, suspended substrate, microwave multiplexer 20 in accordance with an alternative preferred embodiment of the present invention. The multiplexer 20 generally includes a first housing member 22 having an inner surface 23, a second housing member 24 having an inner surface 25, and a substrate 26 disposed between the housing members 22 and 24. The inner surface 23 of housing member 22 further includes a plurality of recessed areas 22a, 22b, 22c (shown in phantom). Similarly, the inner surface 25 of second housing member 24 includes a plurality of recessed areas 24a, 24b, and 24c, which are formed as a mirror-image of the recessed areas 22a, 22b, 22c of the first housing member 22.

The substrate 26 includes an independent first channel circuit element 26a, an independent second channel circuit element 26b, and an independent third channel circuit element 26c. Each of the first, second and third channel circuit elements 26a, 26b, 26c preferably comprise an elliptical function filter.

Each of the first, second and third channel circuit elements 26a, 26b and 26c, respectively, include an input 28a, 28b and 28c, respectively, which are all tied together and also to a common input junction 30. Each of the first, second and third channel circuit elements 26a, 26b and 26c further include an independent output 32a, 32b and 32c, respectively. The substrate 26 is preferably comprised of a dielectric material, and more preferably an approximately 0.020 inch thick section of Duroid 5880 having a dielectric constant of about 2.2. It will be appreciated, however, that the thickness of substrate 26 could vary significantly to suit the needs of specific applications.

When assembled together, the substrate 26 is secured between the first and second housing members 22 and 24 such that the first channel 26a lies directly in between the first recessed areas 22a and 24a, the second channel circuit element 26b lies directly between the second recessed areas 22b and 24b, and the third channel circuit element 26c lies directly between the third recessed areas 22c and 24c of the first and second housing members 22 and 24. Accordingly, the circuit elements 26a, 26b and 26c are "suspended" on the substrate between the first and second housing members 22 and 24. The housing members 22 and 24 are preferably manufactured from aluminum The first channel circuit element 26a is operable to receive an RF input signal preferably in the range of about 3 to 18 GHz and to provide a signal at its output 32a having a frequency range of about 3 to 5.5 GHz. The second channel circuit element 26b simultaneously receives the same RF input signal input to the common input junction 30 at its input 28b and provides an RF output signal at its output 32b having a frequency range of preferably about 5.5 to 10.0 GHz. The third channel circuit element 26c simultaneously receives the RF signal input to the common input junction 30 at its input 28c, and provides an RF output signal at its output 32c which is an RF signal having a frequency of preferably about 10.0 to 18 GHz. Accordingly, the frequency ranges at the outputs of the three channel circuits elements 26a, 26b and 26c are contiguous.

The channel circuit elements 26a, 26b and 26c further each have a length which is generally less than ⅛ wavelength in length, instead of the conventional ½ wavelength in length elements used in conventional highpass/lowpass multiplexers. Like the microstrip multiplexer 10 of the first embodiment of the invention, the short circuit elements 26*a*, 26*b* and 26*c* greatly enhance the out-of-band rejection performance of the suspended substrate multiplexer 20. Insertion noise is typically less than 0.7–0.8 dB. Moreover, all of the circuit elements 26*a*, 26*b*, 26*c* can be printed or etched on the substrate 26, thus making the suspended substrate multiplexer 20 well suited for low cost, mass production applications.

The overall dimensions of the suspended substrate multiplexer 20 also provide for a more compact multiplexer than the previous multiplexer designs such as those in accordance with combline and suspended substrate multiplexers. The suspended substrate multiplexer 20 has a length of about 2 inches, a height of about 2.5 inches and a thickness of about 0.4–0.5 inch. The overall weight of the suspended substrate multiplexer 20 is about 2.1 ounces. The microstrip multiplexer 10 and suspended substrate multiplexer 20 of the preferred embodiments are each implemented without the use of any tuning screws whatsoever. In contrast, conventional combline multiplexers incorporate between about 60 to 70 tuning screws for enabling proper calibration. The microstrip and suspended substrate multiplexers 10 and 20, respectively, of the preferred embodiments also only require about 120 hours each to assemble, compared to roughly about 700 hours to assemble and tune a conventional combline multiplexer. The production costs associated with conventional combline filters are also estimated to be approximately six times that of the microstrip and suspended substrate multiplexers 10 and 20 of the preferred embodiments of the invention.

Accordingly, the microstrip multiplexer 10 and suspended substrate multiplexer 20 of the preferred embodiments of the present invention represent greatly simplified multiplexers both from design and manufacturing standpoints. The multiplexers 10 and 20 are also particularly well suited to mass production applications and provide multiplexers which are significantly less bulky and more compact than previously designed multiplexers. Moreover, the common input junction design of the multiplexers 10 and 20 reduces the number of filters needed to accomplish multiplexing and makes possible multioctave multiplexer designs having at least a 6:1 bandwidth. The multiplexers 10 and 20 further require significantly less development and manufacturing time as compared to prior designs of multiplexers.

While the above detailed description describes the preferred embodiments of the present invention, it will be understood that the present invention is susceptible to modification, variation and alteration without deviating from the scope and fair meaning of the subjoined claims.

What is claimed is:

1. A common input junction, multioctave, printed microwave multiplexer, comprising:

means for forming a common input junction adapted to receive a broad band radio frequency input signal;

means for forming a first multiplexer channel, said first multiplexer channel having an input coupled directly to said common input junction and being operable to provide a radio frequency output signal having a first frequency range, said first multiplexer channel means having a circuit element being no greater than approximately 0.125 wavelength in length;

means for forming a second multiplexer channel, said second multiplexer channel having an input coupled directly to said common input junction and being operable to provide a radio frequency output signal having a second frequency range contiguous with said first frequency range, said second multiplexer channel means having a circuit element being no greater than approximately 0.125 wavelength in length; and means for forming a third multiplexer channel having an input coupled directly to said common input junction and being operable to provide a radio frequency output signal having a third frequency range contiguous with said second frequency range, said third multiplexer channel means having a circuit element being no greater than approximately 0.125 wavelength in length.

2. The multiplexer of claim 1, wherein said multiplexer channels and said common input junction are in the form of a microstrip.

3. The multiplexer of claim 1, wherein said multiplexer channels and said common input junction are formed on a substrate suspended between a pair of housing members.

4. The multiplexer of claim 1, wherein each said multiplexer channel comprises an elliptical function filter.

5. A common input junction, microstrip, microwave multiplexer, comprising:

a common input junction for receiving a broad-band radio frequency input signal;

a first substrate;

a first multiplexer channel formed on said first substrate, said first multiplexer channel having an input coupled directly to said common input junction and operable to provide a radio frequency output signal having a first frequency range, said first multiplexer channel having one or more circuit elements each being no greater than approximately 0.125 wavelength in length;

a second substrate;

a second multiplexer channel formed on said second substrate, said second multiplexer channel having an input coupled directly to said common input junction and being operable to simultaneously provide a radio frequency output signal having a second frequency range contiguous with said first frequency range, said second multiplexer channel having one or more circuit elements each being no greater than approximately 0.125 wavelength in length;

a third substrate; and a third multiplexer channel formed on said third substrate, said third multiplexer channel having an input coupled to said common input junction and being operable to simultaneously provide a radio frequency output signal having a third frequency range contiguous with said second frequency range, said third multiplexer channel having one or more circuit elements each being no greater than approximately 0.125 wavelength in length.

6. The multiplexer of claim 5, wherein each said circuit element is less than about 0.125 wavelength in length.

7. The multiplexer of claim 5, wherein each said circuit element comprises an elliptical function filter.

8. A common input junction, multioctave, printed microwave multiplexer apparatus comprising:

a first housing member;

a second housing member; and a substrate forming a multiplexer disposed in between said first and second housing members, said multiplexer having a plurality of independent channels, each said channel having an input coupled directly to a common input junction and an independent output, each of said channels being operable to receiving a radio frequency signal input to said common input junction of said substrate and to generate a radio frequency signal at its output having a predetermined bandwidth, each of said channels further having a circuit element no greater than approximately 0.125 wavelength in length.

9. The apparatus of claim 8, wherein said plurality of independent channels comprises first, second and third independent channels;

wherein each said channel generates a radio frequency signal having a predetermined bandwidth, and wherein said bandwidths are contiguous in frequency.

10. The apparatus of claim 8, wherein said independent channels each comprise circuit elements which are etched on said substrate.

11. The apparatus of claim 8, wherein each of said independent channels comprise circuit elements which are printed on said substrate.

12. The apparatus of claim 8, wherein said substrate comprises a dielectric substrate approximately 0.020 inch in thickness.

13. The apparatus of claim 8, wherein said first housing member comprises a plurality of recessed areas shaped in accordance with said independent channels; and wherein said second housing member includes a plurality of recessed areas in the form of a mirror image of said recessed areas of said first housing member.

14. The apparatus of claim 9, wherein said output of said first independent channel provides a radio frequency signal having a bandwidth of approximately 3 to 5.5 GHz; and wherein said output of said second independent channel provides a radio frequency signal in accordance with a bandwidth of approximately 5.5 to 10.0 GHz; and wherein said output of said third independent channel comprises a radio frequency signal having a bandwidth of about 10 to 18 GHz.

15. A common input junction, suspended substrate, microwave multiplexer apparatus comprising:

a first housing member having a plurality of recessed areas on an inner surface thereof;

a second housing member having a plurality of recessed areas formed in an inner surface thereof and in a mirror-image of said recessed areas of said first housing member; and a substrate disposed in between the first and second housing members adjacent said inner surfaces of said first and second housing members;

said substrate including at least first, second and third independent channels, each of said first, second and third independent channels having inputs coupled together and to a common input junction of said substrate, each of said independent first, second and third channels having an independent output;

said first channel having a circuit element no greater than about 0.125 wavelength in length and being operable to receive a multioctave RF input signal between about 3 to 18 GHz and to provide an output radio frequency signal having a frequency in the range of about 3 to 5.5 GHz;

said second independent channel having a circuit element being no greater than about 0.125 wavelength in length and being operable to receive said multioctave RF input signal and to provide a corresponding radio frequency output signal having a frequency in the range of about 5.5 to 10.0 GHz; and said third independent channel having a circuit element being no greater than about 0.125 wavelength in length and being operable to receive said multioctave RF input signal and to provide a radio frequency output signal having a frequency in the range of about 10 to 18 GHz.

16. The apparatus of claim 15, wherein said first, second and third independent channels are formed on said substrate and have a layout in accordance with said recessed areas of said first and second housing members.

17. The apparatus of claim 15, wherein each of said first, second and third channels comprises an elliptical function filter.

18. The apparatus of claim 15, wherein said substrate is formed from a dielectric material and has a thickness of approximately 0.020 inch.

19. The apparatus of claim 15, wherein each of said first and second housing members is formed from aluminum.

20. The apparatus of claim 15, wherein each of said first, second and third independent channels are printed onto said substrate.

21. The apparatus of claim 15, wherein each of said first, second and third channels are etched onto said substrate.

* * * * *